United States Patent [19]

Nelson et al.

[11] Patent Number: 4,673,929

[45] Date of Patent: Jun. 16, 1987

[54] CIRCUIT FOR PROCESSING DIGITAL IMAGE DATA IN A HIGH RESOLUTION RASTER DISPLAY SYSTEM

[75] Inventors: John E. Nelson, Palos Verdes; Edward T. Grossheim; Franklin M. Perelman, both of Los Angeles, all of Calif.

[73] Assignee: Gould Inc., Rolling Meadows, Ill.

[21] Appl. No.: 600,980

[22] Filed: Apr. 16, 1984

[51] Int. Cl.[4] ..... G09G 1/28

[52] U.S. Cl. ..... 340/703; 340/744; 340/793

[58] Field of Search ..... 340/701, 703, 729, 732, 340/744, 747, 748, 750, 789, 793, 798, 799, 802, 803

[56] References Cited

U.S. PATENT DOCUMENTS

| | | | |
|---|---|---|---|
| 4,232,311 | 11/1980 | Agneta | 340/701 |
| 4,342,984 | 8/1982 | Berke et al. | 340/802 |
| 4,361,850 | 11/1982 | Nishimura | 340/793 |
| 4,420,770 | 12/1983 | Rahman | 340/747 |
| 4,439,760 | 3/1984 | Fleming | 340/703 |
| 4,484,187 | 11/1984 | Brown et al. | 340/703 |
| 4,509,043 | 4/1985 | Mossaides | 340/703 |
| 4,520,356 | 5/1985 | O'Keefe et al. | 340/703 |
| 4,574,277 | 3/1986 | Krause et al. | 340/703 |
| 4,580,135 | 4/1986 | Kummer et al. | 340/703 |

*Primary Examiner*—Gerald L. Brigance

*Assistant Examiner*—Jeffery A. Brier

*Attorney, Agent, or Firm*—Robert J. Fox

[57] ABSTRACT

A high resolution raster display includes a central processor for providing image data, a digital image processing circuit for converting the image data to display signals, and an analog display circuit for converting the display signals to drive signals for driving a CRT to form a color raster display on the screen of the CRT. The digital image processing circuit includes a display memory for storing the image data and a programmable attribute look-up table for storing attribute data. Under the control of the central processor, the image data stored in the display memory is read out and is used to address the attribute look-up table which provides attribute signals as an output. A pixel rate converter reads in the attribute signals at a first rate and outputs analog display signals at a second rate which is much higher than the first rate, with a video bandwidth of up to 210 MHz. The display signals are received by the analog display circuit, and are used to generate drive signals for driving the color guns of the CRT. The central processor is also capable of providing intensity control signals to the analog display circuit so that the intensity level of each of the attributes identified by the attribute signals can be varied. In this manner, the intensity of the various types of features on a display (for example, background, map, weather, flight path, etc.) can be varied independently.

11 Claims, 12 Drawing Figures

CIRCUIT FOR PROCESSING DIGITAL IMAGE DATA IN A HIGH RESOLUTION RASTER DISPLAY SYSTEM

CROSS-REFERENCE TO RELATED APPLICATION

This application is related to an application entitled "Analog Display Circuit Including a Wideband Amplifier Circuit for a High Resolution Raster Display System" by Holmes et al. U.S. Ser. No. 600,890 filed on Apr. 16, 1984, and assigned to the assignee of the subject application.

BACKGROUND OF THE INVENTION

This invention relates to high resolution raster display systems and particularly to a circuit for processing the digital image data used to generate the display in such a system.

There exists, in the prior art, a variety of systems for displaying data, including systems for direct viewing of a cathode ray tube (CRT), systems for projection viewing of a CRT, and flat screen systems (e.g., LED displays, plasma display panels, flat CRT panels, etc.). In addition, different systems exist for generating the display for use in a particular display system. These display generation systems include raster scan display systems and stroke writer systems.

Recently, there has been an increased concern with air safety and, in particular, with the quality of air traffic control. This has lead to a study of the air traffic control equipment presently being used, and particularly the displays used in such equipment. It has been found that this equipment should be improved and made uniform. In an effort to update the air traffic control system in the United States, the FAA is seeking to provide air traffic control work stations which are standardized to have a 20″×20″ display of at least 2000 by 2000 pixels (where a pixel is defined as the smallest addressable dot which can be displayed on a screen). The FAA has also required that these displays be capable of providing shaded background areas and a color display.

Displays used in air traffic control have traditionally used stroke writer technology which is capable of providing clear, flicker-free presentations of lines and characters at acceptable brightness levels. However, with this type of display system, it is difficult to provide shaded background areas and to provide a color display. In particular, in order to provide shaded areas on the display, a high power deflection system would be required to move the beam fast enough to create a shaded area. In addition, it would be necessary to provide new equipment in order to generate a color display.

In contrast to stroke writer systems, raster display systems (e.g., standard television) consume relatively less power, have no background shading problem, and currently are capable of providing a color display. However, currently available raster displays are not capable of providing the large viewing area and high resolution required for certain applications, including the large screen, high resolution requirements of the FAA.

At present, commercial television provides 525 horizontal lines which are interlaced 2 to 1, with a 30 hertz refresh cycle. In addition, there are approximately 300 pixels per horizontal line on the display. Thus, the requirement of a display of 2000 lines by 2000 pixels imposes substantially greater data handling requirements on the display system than does commercial television.

Today, a high quality raster display is capable of providing 1280 by 1024 pixels and requires 100 to 120 MHz video bandwidth (as opposed to the commercial broadcast video bandwidth which is approximately 3 MHz). In contrast, the provision of a display of 2048 by 2048 pixels (rounding the 2000×2000 pixel requirement to a power of 2), interlaced 2 to 1, with a refresh cycle of 40 hertz, requires a video bandwidth of approximately 210 MHz.

In addition to the FAA requirements, it is desirable that an air traffic control display have high resolution as well as the capability of displaying various characteristics (e.g., weather, data, flight path, emergency situations, map area, etc.) in a flexible manner which can be altered by an operator who is viewing the display, thereby providing the operator an opportunity to more clearly interpret the data being displayed by adjusting the relative intensity of selected portions of the display. This type of flexible display would also allow an air traffic controller to clarify what he or she sees on the display and to obtain a better view of particular portions of the display (e.g., by brightening or dimming certain display features) in an effort to clarify the image as seen by the operator.

In addition to the need for the above-discussed type of display for use in air traffic control work stations, there is a general need in the display art for large, high resolution displays for use in a variety of industries. For example, such high resolution displays would be advantageous for use as monitors in the fields of computer graphics, CAD/CAM, medicine, defense and other fields.

Therefore, there is a need in the display art, for circuitry capable of processing digital image data at a high data rate in order to provide the processed image data as display signals for use in a high resolution raster scan display system. There is also a need for such processing circuitry which allows certain attributes of the display to be programmable, so that the display can be programmed to display different types of features as required for different types of displays. Further, there is a need for analog display circuitry which is capable of receiving the high speed display signals and driving high resolution raster displays. There is also a need for analog circuitry which is capable of changing the relative display intensities of certain features of the display.

SUMMARY OF THE INVENTION

It is an object of the present invention to provide a circuit for processing digital image data in a high resolution raster display system which overcomes the deficiencies inherent in prior art display systems.

In particular, it is an object of the present invention to provide a circuit which is capable of generating image data or receiving image data from a source of image data, storing the image data for an entire display (i.e., one picture) in memory, reading the image data out of memory, and providing display signals for each pixel at a high rate to an analog display circuit, so that the raster display system is capable of providing a high resolution raster display.

A further object of the present invention is to provide a circuit which stores a plurality of attributes which can be programmed under the control of the operator, wherein the image data which is stored in the circuit is used to determine which of the stored attributes are to be read out as attribute signals, and wherein the attribute signals are converted to display signals which are transmitted to the analog display circuit at a high rate, so that a high resolution raster display can be generated.

The circuit of the present invention has a number of novel features as set forth below. A graphics processor is connected to a source of image data and control signals (e.g., a central processor). A display memory is connected to the graphics processor to receive image data to be written therein by the graphics processor (or the central processor) and to read out the stored image data under the control of the graphics processor. The display memory provides the read-out data to an attribute look-up table (having attribute data stored therein) which reads out attribute signals in dependence upon the image data input from the display memory. The attribute signals are transmitted to a pixel rate converter at a first rate, converted to digital data at a second, higher rate, and then decoded by a decoder which provides display signals as a high speed input to an analog display circuit.

The circuit of the present invention is capable of outputting data (i.e., display signals) from the pixel rate converter at a high rate, so that the raster display system is capable of providing a high resolution, flicker-free, raster display. In addition, the provision of the attribute look-up table allows the operator to program the attributes or display features (e.g., alphanumerics, maps, weather, flight plan, etc.) to be displayed on the screen, so that the type of image displayed can be tailored to the particular type of image display for which the display system is being used.

The circuit of the present invention is particularly useful as a part of a raster display system used in an air traffic control work station. This is because the high data rate at the output of the pixel rate converter allows for provision of a high resolution display which is critical to proper monitoring of air traffic. In addition, the circuit of the present invention is particularly suitable for use in other types of display systems which require a high resolution image. These additional applications might include use in computer graphics display systems, display systems used in medicine (e.g., diagnostic equipment), CAD/CAM systems and complex display systems used in military detection and scanning systems.

These together with other objects and advantages, which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
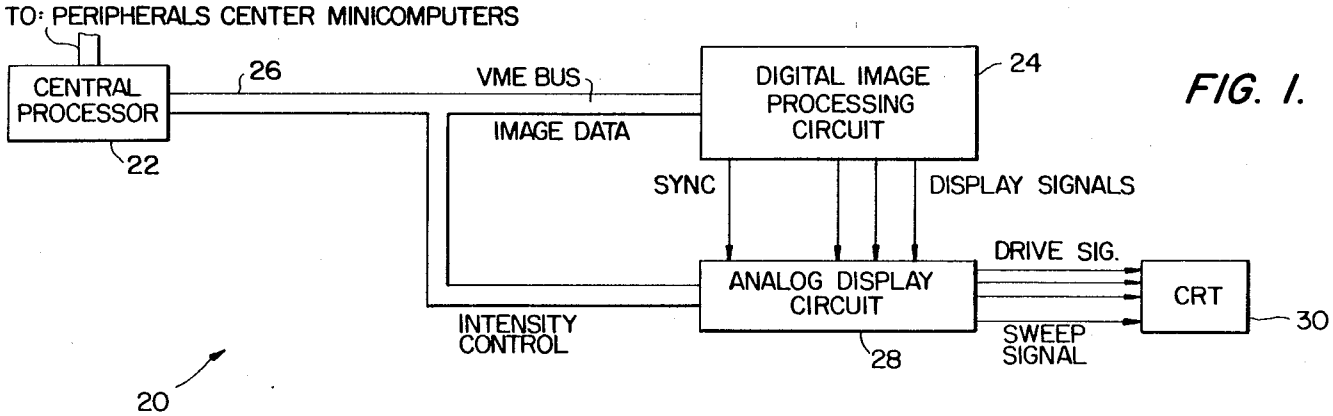
FIG. 1 is a block diagram of one type of display system in which the digital image processing circuit of the present invention can be employed.

FIG. 1 is a block diagram of a display system in which the circuit of the present invention can be employed. In particular, FIG. 1 is a block diagram of a part of a common console 20 which is used to generate the main display for viewing by an air traffic controller. In practice, the common console 20 also includes an auxiliary display, a data entry display, a keyboard, a trackball, an alarm, and touch entry devices for each of the displays. Each air traffic control center includes a plurality of common consoles, each of which has a central processor 22 connected to one or more center minicomputers. In turn, the center minicomputers are interconnected to a main host computer. For convenience, FIG. 1 only indicates that the central processor 22 is capable of being connected to peripherals and center minicomputers in order to make it clear that the central processor 22 is capable of receiving image data which is to be displayed on the main display of the common console 20.

Referring to FIG. 1, the central processor 22 provides digital image data (e.g., from a center minicomputer) to a digital image processing circuit 24 which is the subject of the present invention. In the preferred embodiment, the central processor 22 is a Motorola MC 68020 microprocessor and is connected to the digital image processing circuit 24 via a bus 26. In the preferred embodiment, the bus 26 is a Motorola VME bus. The central processor 22 is also connected to an analog display circuit 28, via the bus 26, in order to provide intensity control signals to the analog display circuit 28 under the control of an operator (e.g., an air traffic controller). The digital image processing circuit 24 of the present invention receives the image data from the central processor 22, and generates display signals for a monochrome display or a color display (i.e., red, blue and green display signals) at a rate of 210 mega-pixels per second. The digital image processing circuit 24 also provides a sync signal to the analog display circuit 28. The analog display circuit 28 generates three voltage output signals which are received by a CRT 30 (which is the main display of the common console 20) for control of the red, blue and green color guns which are used to form the display. The analog display circuit 28 also receives the intensity control signals from the central processor 22 and varies the intensity of selected features displayed on the screen of the CRT 30 under the control of the operator. The analog display circuit 28 also generates a sweep signal in dependence upon the sync signal generated by the digital image processing circuit 24, and the sweep signal is used to control the horizontal sweep of the CRT 30.

As discussed above, the system of FIG. 1 was particularly designed as a part of a common console 20 for use in an air traffic control work station. Thus, in order to meet FAA requirements regarding display size (20″×20″) and resolution, the circuit of the present invention was designed to generate data for a picture of 2048 by 2048 pixels with a 2 to 1 interlaced raster, a 40 hertz frame, and an 80 hertz field rate. The horizontal scanning frequency is 82.2 kilohertz and the video bandwidth required is 210 MHz. The use of these specifications meets all FAA resolution requirements, provides a color display, and overcomes background shading problems which are present in other technologies. In the preferred embodiment, the CRT 30 incorporates the Sony Trinitron color system which provides significant advantages for use in a high resolution display. At the present time, Sony does not produce a commercially available 20″×20″ CRT; however, Sony does produce a 30″ diagonal CRT which can be used to generate a "scaled down" 1792 by 1792 pixel display of 18″ by 18″. Thus, the Sony 30″ diagonal CRT can be used in conjunction with the digital image processing circuit 24 of the present invention to produce a display having substantially higher resolution than is currently available.

Figure 2:
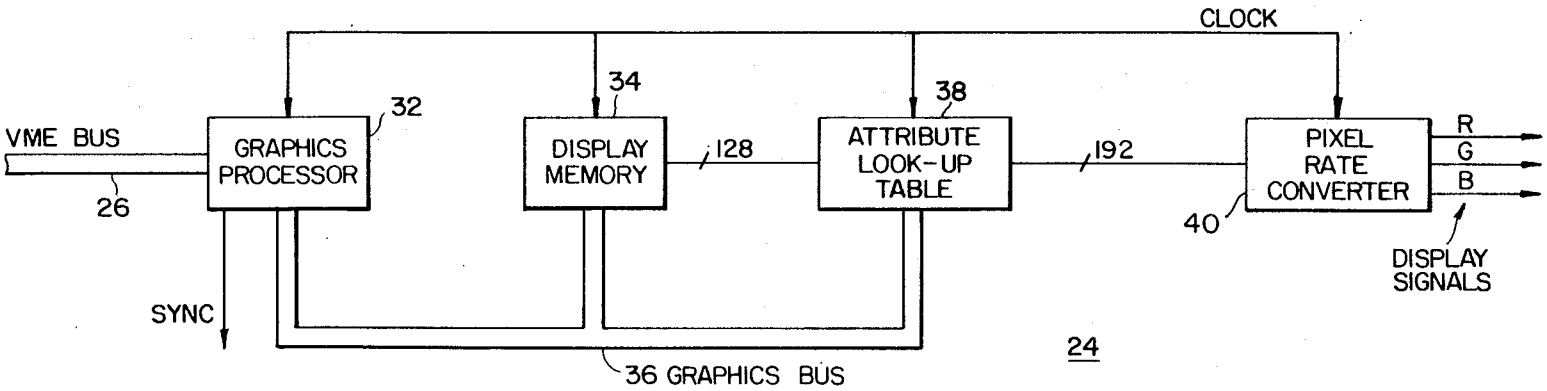
FIG. 2 is a block diagram of the digital image processing circuit of the present invention.

FIG. 2 is a block diagram of the digital image processing circuit 24 of the present invention. The digital image processing circuit 24 includes a graphics processor 32 which receives image data from the central processor 22 over the bus 26. The graphics processor 32 provides address data and write data to a display memory 34 over a graphics bus 36. The display memory 34 is arranged so that memory address is directly related to screen position on the CRT 30. When data is read from the display memory 34, under the control of the graphics processor 32, the image data (8 bits per pixel) which is read from the display memory 34, is used to address an attribute look-up table 38. The attribute look-up table 38 is programmable and stores attribute data which allows the 8 bits per pixel read from the display memory 34 to have any desired meaning in terms of the features which appear on the screen of the CRT 30. For example, attributes can be used to designate layers on a map. The layers could include a geographical map layer, a data block layer, a weather layer, a flight plan layer, etc. By selectively changing the attributes stored in the attribute look-up table 38, a layer can be taken away, returned, its color changed, etc. For applications relating to air traffic control, radar aircraft displays are used and text information is often overlaid on the same display (e.g., a flight plan). The operator might want to switch immediately from a map display to a text display and the attributes required would be completely different. For example, in a text display, it might be desirable to have an underlying reverse video blinking particular data, while the radar display might have different colors for weather, targets, etc. Sets of attributes stored in the attribute look-up table can include 256 different colors on the screen, requirements that certain portions of the screen blink, an independent map, an independent set of symbols for aircraft, data, for weather etc. Thus, the provision of the programmable attribute look-up table 38 prevents the display system from being rigidly bound to a specific set of attributes. This is in contrast to many prior art displays wherein the display memories are divided into pixel memory planes which are assigned a specific function by hard wiring. For example, two planes might be assigned for red color pixels, two planes for blue color pixels and two for green color pixels, etc. This type of preassignment restricts the flexibility of the display. For example, if only two planes per color are assigned, the pixel is then limited to four intensity levels per color, which may be inadequate for certain colors, and overly adequate for other colors.

The attribute look-up table 38 can be programmed through the central processor 22 to assign attributes to the 256 codes possible when 8 bits per pixel are employed. That is, the content of each address in the attribute look-up table 38 can be set via software from the central processor 22 to adjust the meaning to be given to an 8-bit pixel stored in the display memory 34. This provides enormous flexibility and, for example, allows both monochrome and color modes of operation to be readily available. In the monochrome mode the attribute look-up table 38 can be programmed with a set of data which enables only the green beam in the CRT 30 and uses the 8 bits per pixel stored in the display memory to provide numerous intensity levels for the green beam. Then, when a color display is to be generated, the attribute look-up table 38 can be reloaded with different data to trade off some of the intensity variation in the green beam for other color variation. This can be done without altering any hardware, merely by changing the data stored in the attribute look-up table 38.

In the preferred embodiment, 16 pixels of 8 bits each (128 bits) are read from the display memory 34 and are input in parallel to the attribute look-up table 38 which converts the 8 bits of pixel data into 4 bits of intensity data for each color gun (i.e., red, green and blue). Then, attribute signals, consisting of 16 pixels of 12 bits each, are output by the attribute look-up table 38. The attribute signals are provided to the pixel rate converter 40 which includes a master clock oscillator running at 210 MHz. The master clock is divided down and provided to the graphics processor 32, the display memory 34 and the attribute look-up table 38. The graphics processor 32 generates horizontal and vertical raster synchronization timing for input to the analog display circuit 28 on the basis of the clock signal input to the graphics processor 32.

The primary function of the pixel rate converter 40 is the serialization of the pixel data at the 210 MHz video rate, wherein the attribute signals (i.e, pixel data) is transmitted from the attribute look-up table 38 in wide parallel words at a 13 MHz rate. The pixel rate converter 40 decodes the serialized pixel data and outputs the result as the display signals to the analog display circuit 28. As discussed in detail below, there are 10 possible display signals output by the pixel rate converter 40 for each of the color guns of the CRT 30. Part of the coding originating in the attribute look-up table includes data indicating the type of pixel to be displayed (e.g., a data pixel, a map pixel, a background pixel, control target pixel, flight path pixel, etc.) and the type or category of pixel is distinguished because it is necessary to be able to separately adjust each type of pixel regardless of its color. For example, if the map pixels have been assigned a green color and the operator changes the intensity of the data blocks, they should all change. If the attribute look-up table 38 is then loaded with information which makes the map pixels blue, then the operator must be able to employ the same intensity control to change the intensity of the blue map pixels. Thus, there is provided, independent intensity control for nine classifications or types of pixel and a background.

In the preferred embodiment, the pixel rate converter 40 is housed adjacent a portion of the analog display circuit 28 and is physically separated from the remainder of the digital image processing circuit 24. In essence, bus data width is traded for clock rate to accommodate the physical separation between the pixel rate converter 40 and the remainder of the digital image processing circuit 24. This also allows all of the high speed digital and analog circuitry to be confined to one physical location for ease of EMI containment.

Figure 3:
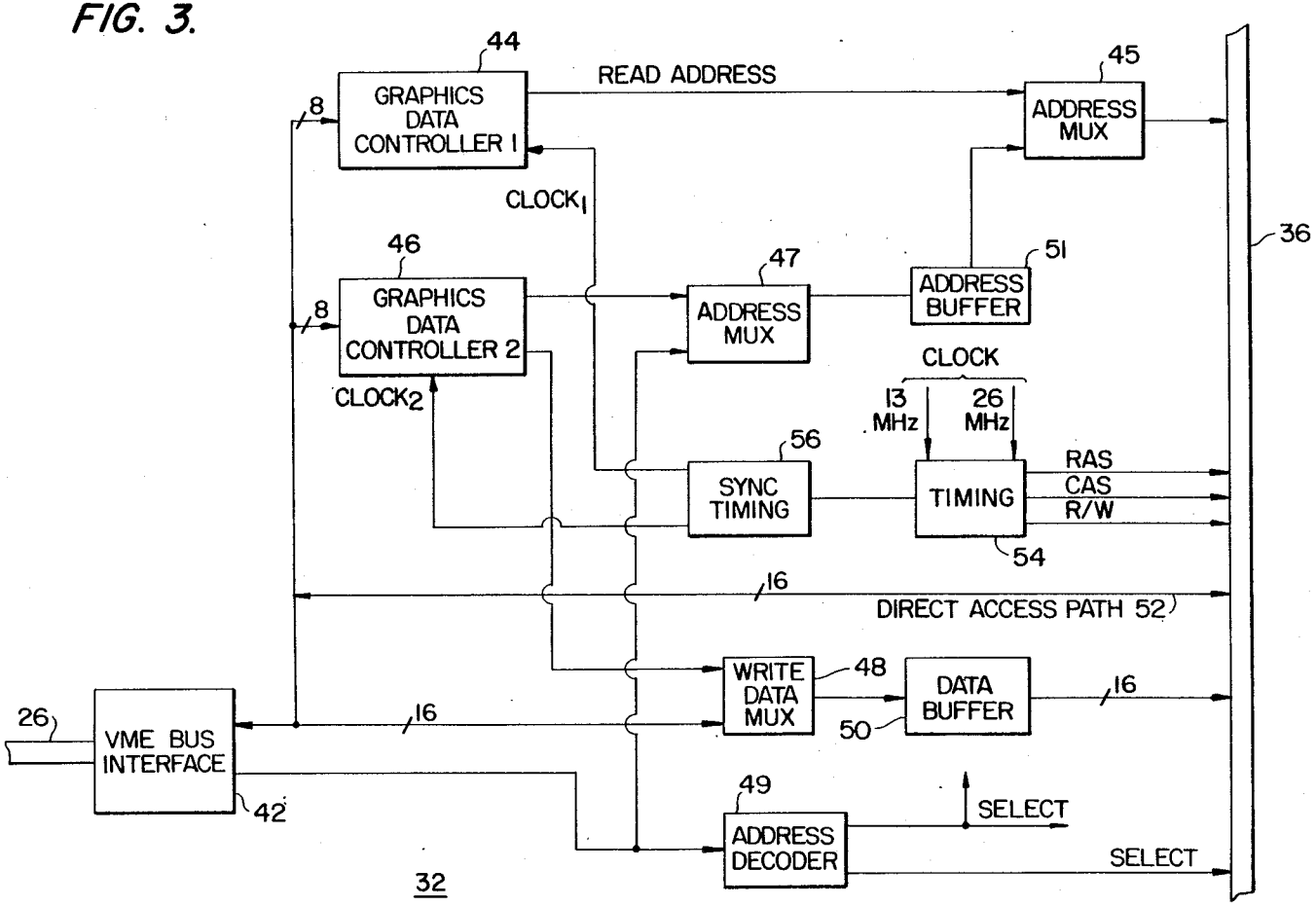
FIG. 3 is a block diagram of the graphics processor 32 of FIG. 2.

FIG. 3 is a block diagram of the graphics processor 32 of FIG. 2. The graphics processor 32 operates under the control of the central processor 22 and does not control the bus 26, but instead receives data from the bus 26. The bus 26 provides 16 bits of data, 24 bits of address and control signals to a bus interface 42. Two graphics data controllers 44 and 46 are connected to the bus interface 42. In the preferred embodiment, the graphics data controllers 44 and 46 are NEC 7220 LSI Graphics Display Controllers. The graphics data controller 46 generates and controls input of symbol, vector, arc and circle pixel patterns which are written into the display memory 34 via a write data multiplexer 48 and a first in, first out data buffer 50. In addition, a direct access path 52 is provided, so that the central processor 22 can provide or receive data directly to/from the display memory 34 or the attribute look-up table 38, via the direct access path 52 and the graphics bus 36. Alternatively, the central processor 22 can provide data to the display memory 34 via the write data multiplexer 48, the data buffer 50 and the graphics bus 36. If the central processor 22 is to write data directly into the display memory 34 it must first verify that the graphics data controller 46 is not currently writing data into the display memory 34. The central processor 22 knows when the graphics data controller 46 is writing data in the display memory 34 because the graphics data controller 46 operates under the control of the central processor 22. Thus, the central processor 22 and the graphics data controller 46 share one port to the display memory 34. If the central processor 22 does not provide write data through the direct access path 52 or the write data multiplexer 48, then command data is provided to either the graphics data controller 44 or the graphics data controller 46. The graphics data controller 44 is dedicated to refreshing the screen by sending address data to the display memory 34, via an address multiplexer 45 and the graphics bus 36, for display on the CRT 30, so that the display memory 34 is sequenced through its storage locations as the screen is refreshed. The central processor 22, the graphics data controller 44 and the graphics data controller 46 share access to the display memory 34 at all times. An address multiplexer 47 is used to select which of the graphics data controller 46 and the central processor 22 is to have access to the display memory 34, and the address data is provided to an address buffer 51. The address multiplexer 45 selects which of the output of the address buffer 51 and the graphics data controller 44 is to have access to the display memory 34. The timing is divided into phases, so that the graphics data controller 44 is able to have the display memory 34 read out image data which is to be displayed on the CRT 30, because the screen must always be refreshed. A timing circuit 54 receives 13 MHz and 26 MHz clock signals from the pixel rate converter 40 and provides a timing signal to a sync timing circuit 56 which alternately generates a first clock signal (Clock 1) and a second clock signal (Clock 2) for input to the graphics data controller 44 and the graphics data controller 46, respectively. The first clock signal enables the graphics data controller 44 to generate a read address signal for reading data from the display memory 34, and the second clock signal enables the graphics data controller 46 to write data into the display memory 34. The timing circuit 54 also provides a row address signal (RAS), a column address signal (CAS) and a read/write signal (R/W) to the display memory 34 via the graphics bus 36.

As noted above, the graphics processor 32 operates under the control of the central processor 22. Accordingly, an address decoder circuit 49 is included within the graphics processor 32 to decode a signal indicating which portion of the graphics processor 32 (e.g., the graphics data controller 44, the graphics data controller 46, etc.) is selected by the central processor 22. In addition, the address decoder circuit 49 is capable of providing a select signal to the display memory 34 via the graphics bus 36.

Figure 4:
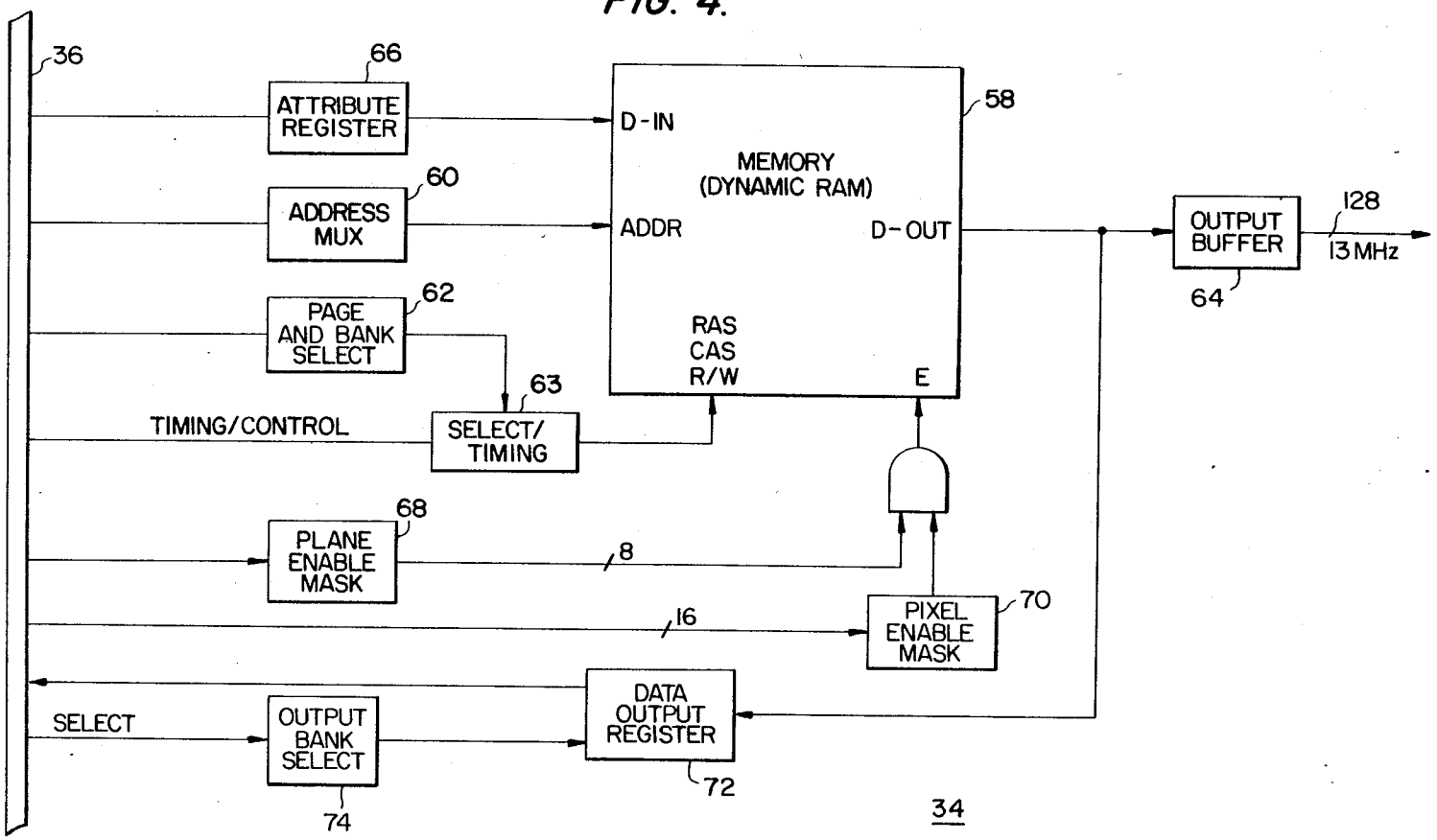
FIG. 4 is a block diagram of the display memory 34 of FIG. 2.

FIG. 4 is a block diagram of the display memory 34 which is mainly comprised of a memory 58 including 256 K dynamic RAMS which are organized in 8 pixel planes. Each plane includes sixty-four 256 K DRAMs to provide the capacity for maintaining four separate images (i.e., four independent 2048×2048 pixel "pages") in memory 58. Thus, one of the pages can be selected for display, while the other three may be written into concurrently. The address multiplexer 45 provides address data to an address multiplexer 60 and a page and bank select circuit 62, via the graphics bus 36, to address the memory 58. In dependence upon the address data, 64 sequential horizontal pixels of 8 bits each (i.e., one bit from every DRAM in memory 58) are read out during a single read cycle as determined by a timing/control input to the memory 58. This occurs at a 3.3 MHz rate. An output buffer 64 provides image data comprising 16 pixels of 8 bits each (128 bits) to the attribute look-up table 38.

The display memory 34 also includes an attribute register 66 for designating the attribute of a pattern to be written on the screen. For example, the data stored in the attribute register indicates whether the type of pixel to be written in memory is a line pixel, character pixel, map pixel, etc. The page and bank (in the page) in memory which are to be written into are selected via the page and bank select circuit 62 and a select/timing circuit 63, and a plane enable mask 68 and a pixel enable mask 70 are set. Data is written into the memory 58 by enabling the memory 58 (E input) for storing the type of data indicated by the attribute register 66 for up to 16 pixel planes. The plane enable mask 68 allows only selected planes of the memory 58 to be written into, while the pixel enable mask performs a similar function with respect to the number of pixels to be written into simultaneously. The central processor 22 and the graphics data controller 46 are capable of writing-in 16 different pixels (128 bits) simultaneously. Thus, the pixel enable mask can be used to limit the number of pixels to be written into to less than 16, for example, in dependence upon the width of a character on a particular line, etc. The central processor 22 operates asynchronously with respect to the display system, so that it is necessary for the central processor 22 to monitor the output of the memory 58 through a data output register 72. Due to the large amount of data output by the memory 58, the central processor 22 provides the select signal, via the graphics bus 36, to an output bank select circuit 74 which selects only a portion of the data from the data output register 72.

Figure 5A:
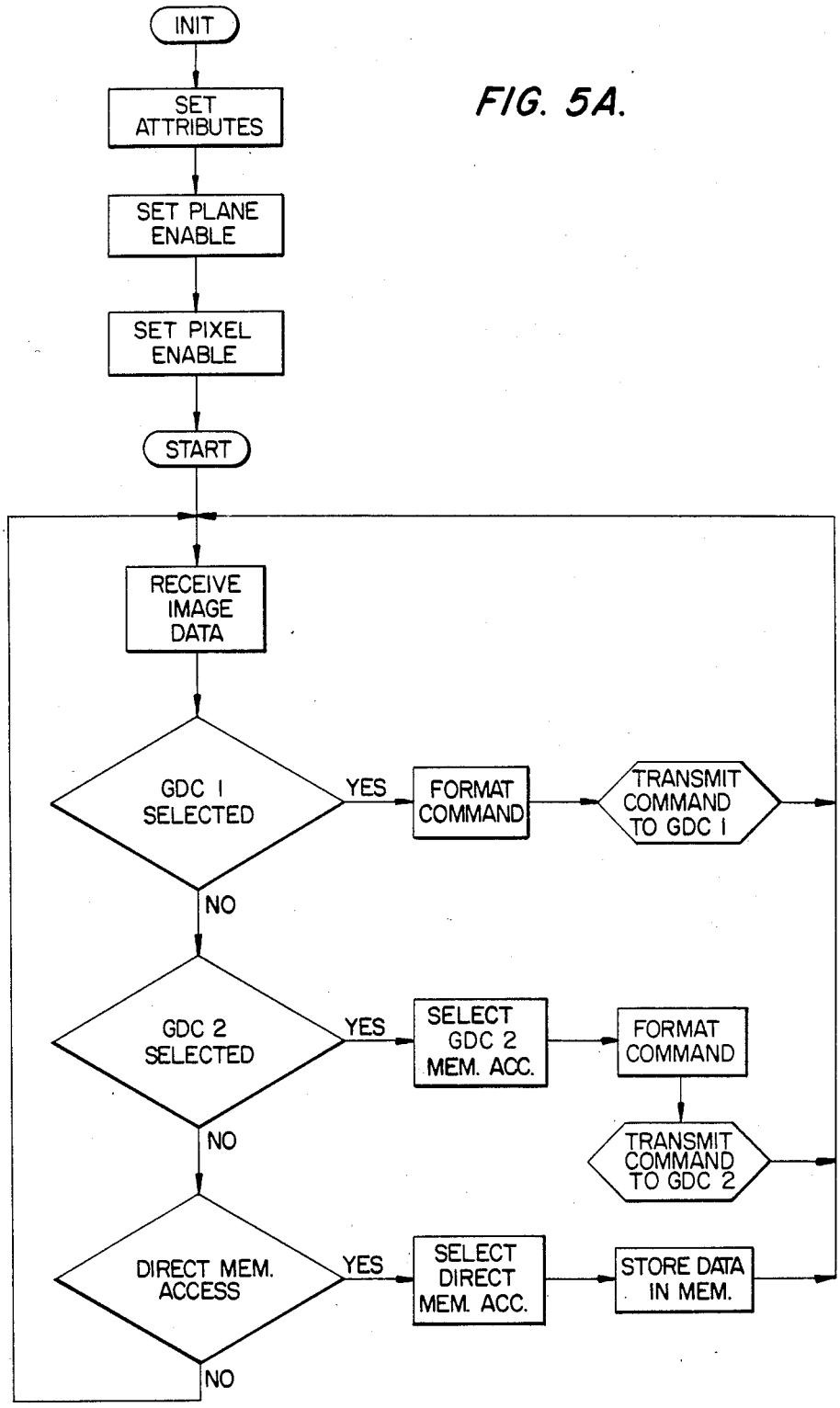
FIGS. 5A and 5B are flow charts describing the operation of the central processor 22 of FIG. 1 in controlling the graphics data controllers 44 and 46 of FIG. 3 to write data into the display memory 34 and to read data from the display memory 34.
Figure 5B:
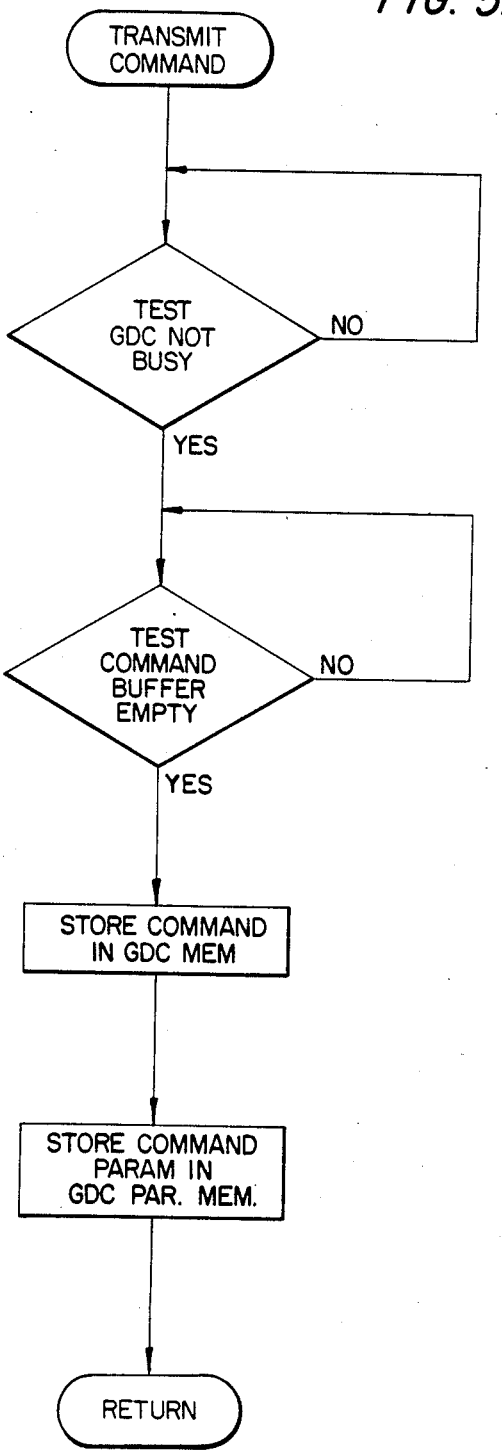

FIGS. 5A and 5B are flow charts for illustrating the operation of the central processor 22 and its control of the graphics data controller 44 and the graphics data controller 46 in the graphics processor 32. Referring to FIG. 5A, the central processor 22 initializes the system by setting attributes in the attribute look-up table 38, setting the plane enable mask 68, and setting the pixel enable mask 70. After initialization, the graphics processor 36 receives image data for display and determines whether the graphics data controller 44 has been selected. If the graphics data controller 44 has been selected, the central processor 22 formats a command for the graphics data controller 44 and transmits the command to the graphics data controller 44 using the transmit command subroutine (FIG. 5B). If the graphics data controller 44 is not selected, the central processor 22 determines whether the graphics data controller 46 has been selected to write data into the display memory 34. If so, the central processor 22 selects the memory access state for the graphics data controller 46, formats a command for the graphics data controller 46 and executes the transmit command subroutine. If the graphics data controller 46 has not been selected to access the display memory 34, the central processor 22 determines whether it will access the display memory 34 directly. If so, the central processor 22 selects the direct access state and stores the data in the display memory 34. The central processor 22 then returns to receive more image data for display. If the central processor 22 is not to access the RAM directly, it also returns to receive more image data for display.

In the transmit command subroutine (FIG. 5B), the central processor 22 determines whether the selected graphics data controller (44 or 46) is not occupied. If it is occupied, then the central processor 22 returns and tests again. If the selected graphics data controller (44 or 46) is not occupied, the central processor 22 tests to determine whether the command data buffer is empty (i.e., whether there are other commands waiting to be carried out), and if it is not, testing continues until the command data buffer is empty. If the command data buffer is empty, the central processor 22 stores a command in the internal memory of the selected graphics data controller (44 or 46) stores the parameters (i.e., data) in parameter memory locations, and returns to the main program to receive more image data for display.

As discussed above, in the preferred embodiment, the graphics data controllers 44 and 46 are formed by NEC 7220 LSI Graphics Display Controllers. Accordingly, once the central processor 22 has provided the graphics data controllers 44 and 46 with the appropriate command and parameters, the graphics data controllers 44 and 46 operate under the control of their own internal programs to output the necessary data.

Figure 6:
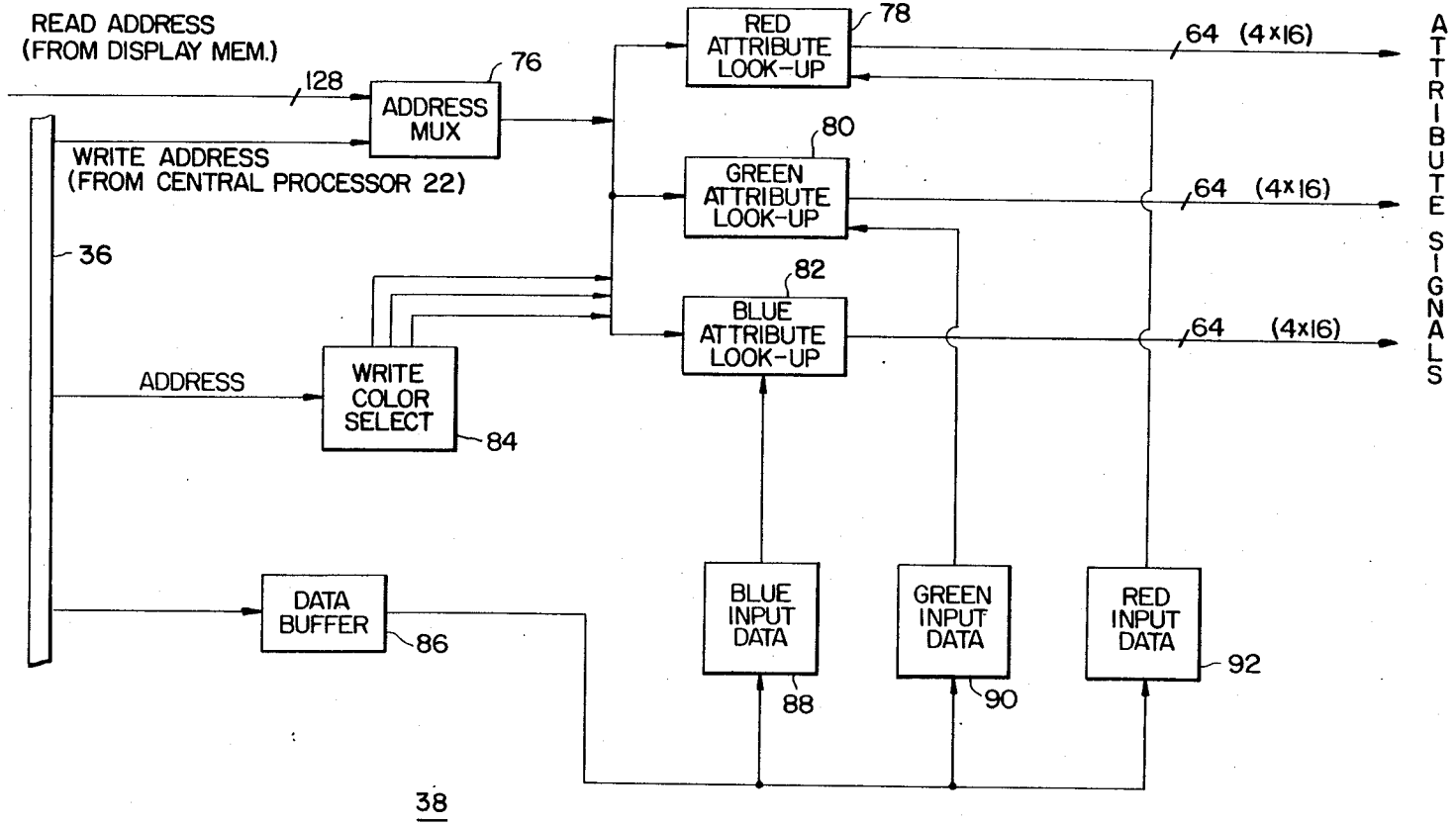
FIG. 6 is a block diagram of the attribute look-up table 38 of FIG. 2.

FIG. 6 is a block diagram of the attribute look-up table 38 of FIG. 2. The attribute look-up table 38 converts the 8 bits of pixel data provided by the display memory 34 into 4 bits of intensity data for each of the three electron guns of the CRT 30 (i.e., 12 bits total). The output buffer 64 of the display memory 34 provides groups of 16 pixels of 8 bits each in parallel (i.e., 128 bits total) at 13 MHz to an address multiplexer 76. The attribute look-up table 38 includes a red attribute look-up table 78, a green attribute look-up table 80 and a blue attribute look-up table 82. Each of these tables (78, 80 and 82) are formed by 1K by 8 RAMS. Due to the amount of data being output by the display memory 34, each of the tables (78, 80 and 82) includes 16 identical sets of attributes, so that all 16 pixels read from the display memory 34 at one time can be used to address a set of the attribute look-up tables 78, 80 and 82 at the same time. Thus, for each pixel, the 8 bits defining the pixel are used to address one set of each of the look-up tables 78, 80 and 82. Based on the 8 bit input for each pixel into the tables 78, 80 and 82, 12 bits are output as an attribute signal to the pixel rate converter 40. The output data stream of the attribute look-up table 38 includes 16 pixels of 12 bits each clocked at 13 MHz. In an alternate embodiment, the 8-bit input for each pixel is used to generate an 8 bit output from each of the tables 78, 80 and 82. In this manner, finer color control can be obtained if desired.

The central processor 22 has access to the tables 78, 80 and 82 to allow the attribute associated with any 8 bit pixel code to be changed by a software modification. The appropriate one of the tables 78, 80 and 82, and the write address within the tables, are designated by address data sent by the central processor 22 via the address multiplexer 76 and a write color select circuit 84. A data buffer 86, and blue, green and red input data circuits 88, 90 and 92 are employed to write the new attribute into the indicated address in all 16 sets of the designated one of the tables 78, 80 and 82. The modification of the tables 78, 80 and 82 occurs only during the vertical retrace and therefore occurs instantaneously without disrupting the display. The blue, green and red input data circuits 88, 90 and 92 are shadow RAMS which temporarily store attribute data to be written into the tables 78, 80 and 82 and then write the new data into the tables 78, 80 and 82 when the screen is not active. In the preferred embodiment, the RAMS forming the look-up tables 78, 80 and 82 have sufficient capacity to store separate attribute coding for each of the four pages of the display memory 34. This is particularly advantageous when the display memory 34 stores different kinds of displays (i.e., on each of its four pages) for which different attribute tables are desired. Thus, the provision of storage for separate coding of four attribute tables provides significant advantages with respect to display flexibility. Further, the additional storage may be used to provide different attributes for the same display. For example, it might be desirable to change colors, etc. for certain portions of the display. These sets of attributes could be assigned to different planes in the display memory 34 and the attributes could be readily changed and brought back to vary the color of different features on the display.

Figure 7:
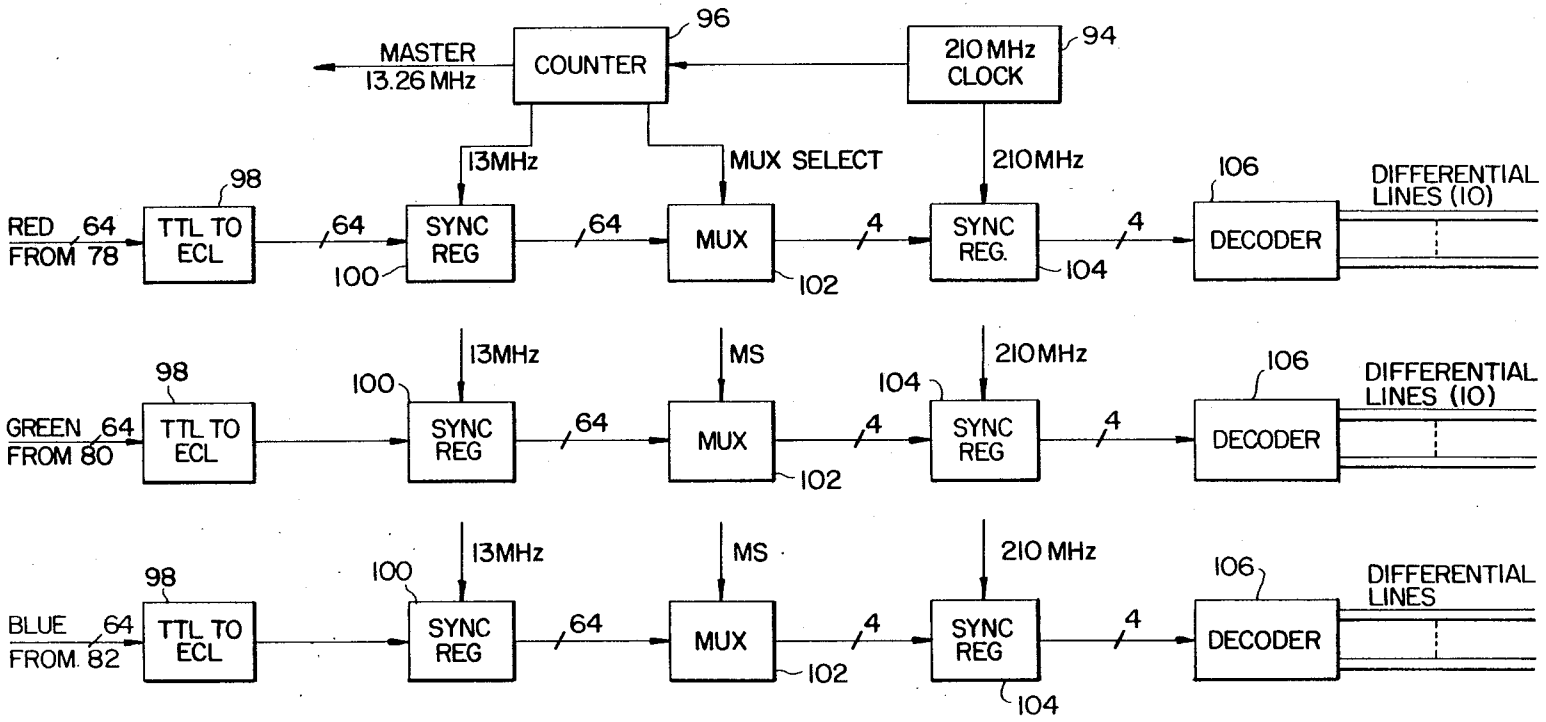
FIG. 7 is a block diagram of the pixel rate converter 40 of FIG. 2.

FIG. 7 is a block diagram of the pixel rate converter 40 of FIG. 2 which receives the attribute signals from the attribute tables 78, 80 and 82 (FIG. 5). The pixel rate converter includes a 210 MHz clock 94 and a counter 96 for providing timing, not only for the pixel rate converter 40 but also for the graphics processor 32, the display memory 34 and the attribute look-up table 38. The pixel rate converter 40 includes TTL to ECL converter circuits 98 for converting the attribute signals to a high speed logic family. In the preferred embodiment, Fairchild 100K family ECL integrated circuits are employed for the TTL to ECL converter circuits 98. The outputs of the TTL to ECL converter circuits 98 are then fed through sync registers 100 to multiplexers 102. The sync registers 100 are provided for timing purposes and the multiplexers 102 speed up the data rate by a factor of 16 by receiving 64 bits and outputting 4 bits at 16 times the rate. The outputs of the multiplexers 102 are sent through sync registers 104 to decoders 106 which decode the 4-bit outputs of the sync registers 104 and provide an output (a display signal) on one of ten differential line outputs for each of the decoders 106.

The outputs of the sync registers 104 comprise 12 bits which are clocked at 210 MHz. Each set of 4 bits corresponds to an input to one of the three color guns in the CRT 30, and must be synchronized to better than 0.5 ns to meet the convergence requirements of the display. Each set of 4 bits which is input to the decoders 106 must be synchronized to 0.5 ns to ensure proper response of the decoders 106 and the analog display circuit 28. In addition, the edges of the pulses input to the analog display circuit 28 must be faster than 1 ns to guarantee proper switching. It is for this reason that 100K family ECL logic circuitry is employed to achieve the desired performance requirements. The pixel rate converter 40 converts (i.e., serializes) a 16 pixel stream down to one pixel which is output at 16 times the rate. It is because of this high data rate (210 MHz) that the pixel rate converter 40 must be located as close as possible to the wideband amplifier which forms a portion of the analog display circuit 28. It is the operation of the pixel rate converter 40 which allows the digital image processing circuit to provide 210 million pixels per second at 4 bits per color gun. In addition, since the pixel rate converter 40 receives input data at a 13 MHz rate, this allows data processing at a slower rate until just prior to input to the analog display circuitry 28.

FIGS. 8–11 are diagrams of the details of the analog display circuit 28. The analog display circuit 28 is the subject matter of the related U.S. application entitled "Analog Display Circuit Including a Wideband Amplifier Circuit for a High Resolution Raster Display System" by Holmes et al., U.S. Ser. No. 600,890 filed on Apr. 16, 1984 and assigned to the assignee of the subject application, the disclosure of which is hereby incorporated by reference.

Figure 8:
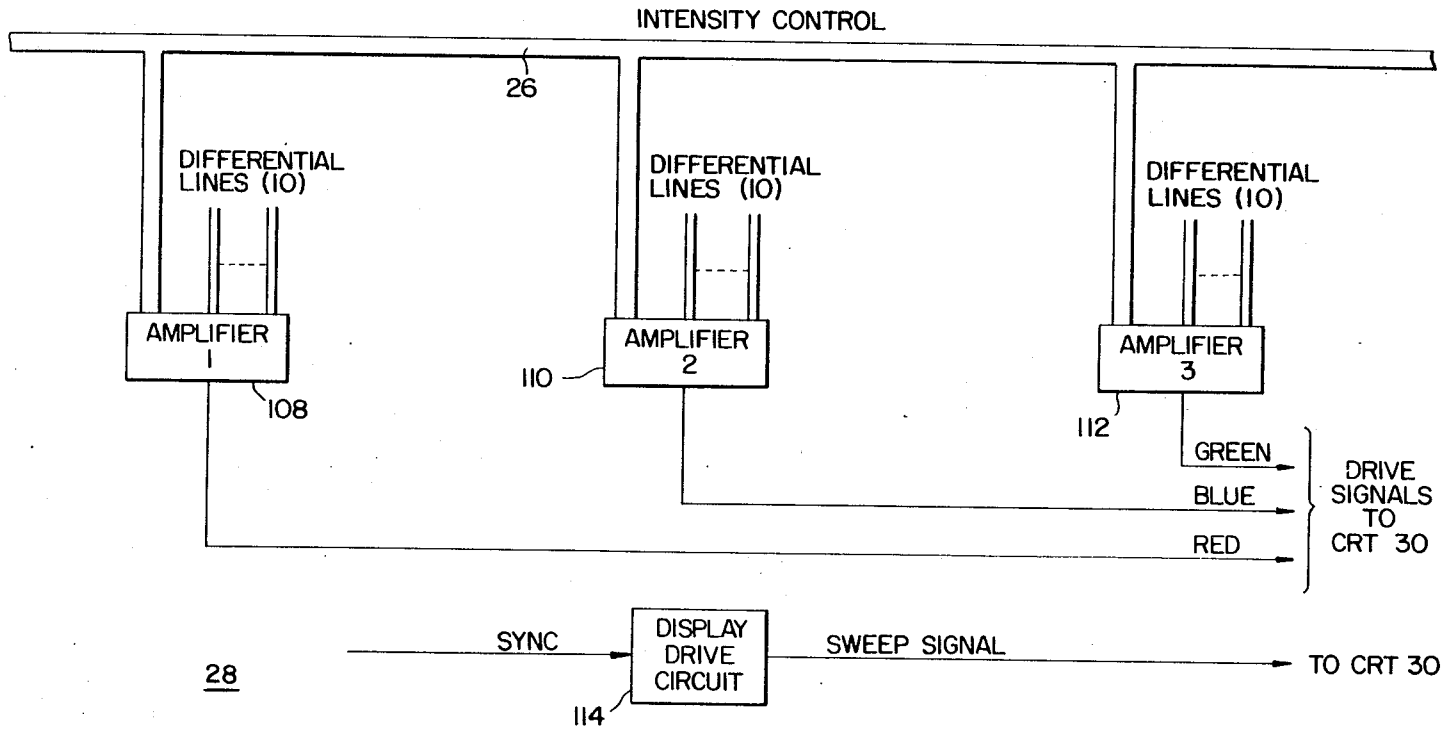
FIG. 8 is a block diagram of the analog display circuit 28 of FIG. 1, which receives display signals from the digital image processing circuit of the present invention and which generates drive signals for driving a CRT.

FIG. 8 is a block diagram of the analog display circuit 28 of FIG. 1. The analog display circuit 28 includes first, second and third amplifier circuits 108, 110 and 112 which form a wideband amplifier, so that an amplifier circuit is provided for each of the red, blue and green color guns of the CRT 30. Each of the amplifier circuits 108, 110 and 112 receives the display signal output by the corresponding one of the decoders 106 in the pixel rate converter 40 (FIG. 7) and generates the corresponding red, blue or green drive signal for input to the CRT 30. The analog display circuit 28 also includes a display drive circuit 114 which receives the sync signal output by the digital image processing circuit 24 and provides a sweep signal for controlling the scan of the CRT 30.

Figure 9:
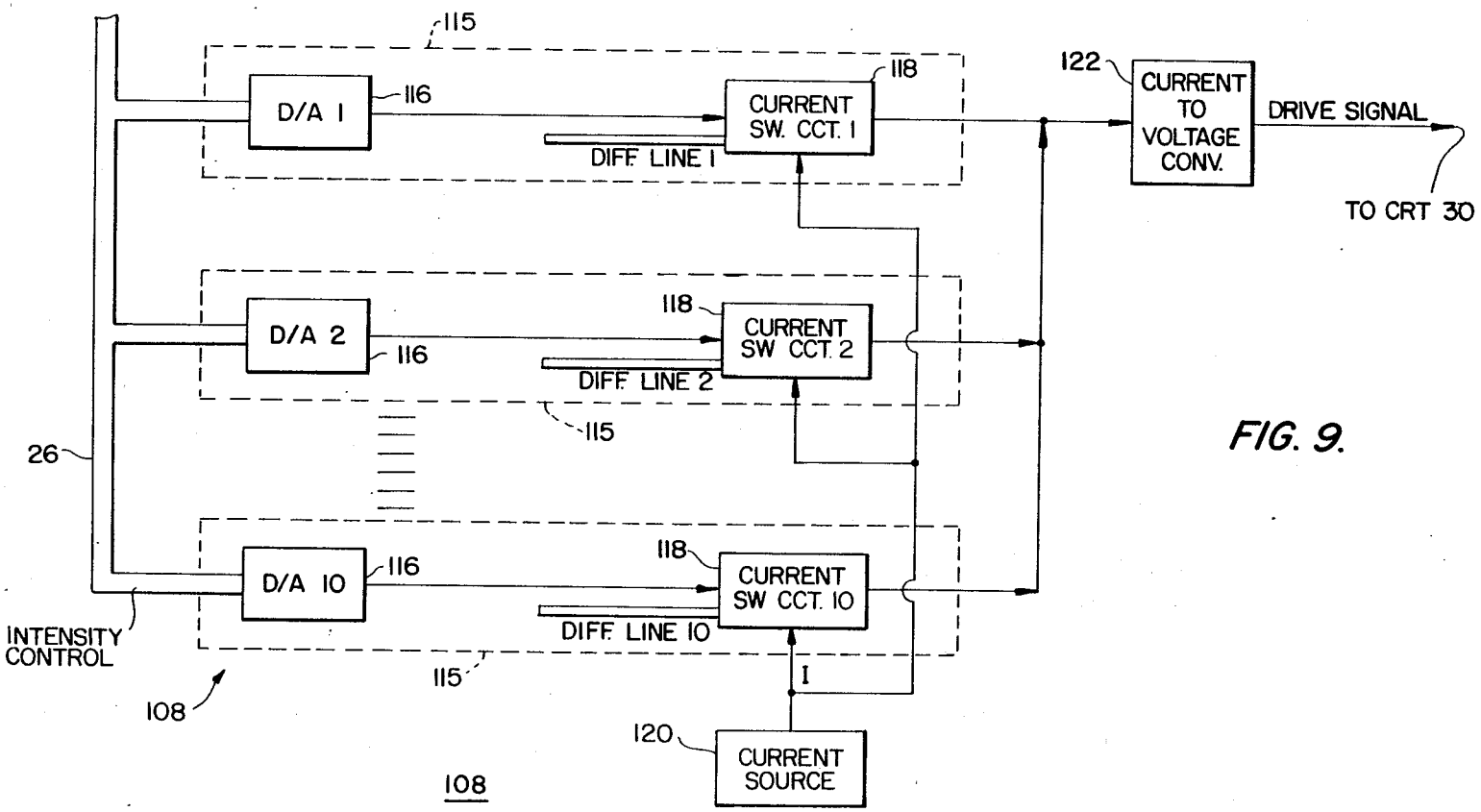
FIG. 9 is a block diagram of the amplifier circuit 108 of FIG. 8.

FIG. 9 is a block diagram of one of the amplifier circuits (e.g., amplifier circuit 108) in FIG. 8. The amplifier circuit illustrated in FIG. 9 is provided for each of the amplifier circuits 108, 110 and 112 in FIG. 8. The amplifier circuit 108 includes ten channels 115, each of which includes an operator adjustable digital to analog converter circuit 116 (which is connected to the bus 26 to receive an intensity control signal from the central processor 22) and a current switching circuit 118. Each digital to analog converter circuit 116 provides a voltage output signal to the current switching circuit 118 which is connected to receive a current from a main current source 120. The current switching circuits 118 are respectively connected to the ten differential line outputs of the decoder circuit 106 connected to the amplifier 108. During a raster scan, one of the ten differential line outputs is selected for each pixel by the decoder circuit 106 and a display signal is generated, so that only one of the ten current switching circuits 118 is selected at any one time. Each of the ten differential line inputs to the current switching circuits 118 (and thus, each of the ten channels 115) corresponds to a particular attribute of the display, for example, background map, symbology, weather information, alphanumerics, flight paths, radar, etc. The display signal output by each decoder 106 selects one of the ten attributes for each pixel and acts as a switching signal for the differential line input of only that current switching circuit 118 which is selected. The selected current switching circuit 118 provides a current output signal to a current to voltage converter circuit 122 which generates the drive signal (in this case the red drive signal) for the CRT 30.

Figure 10:
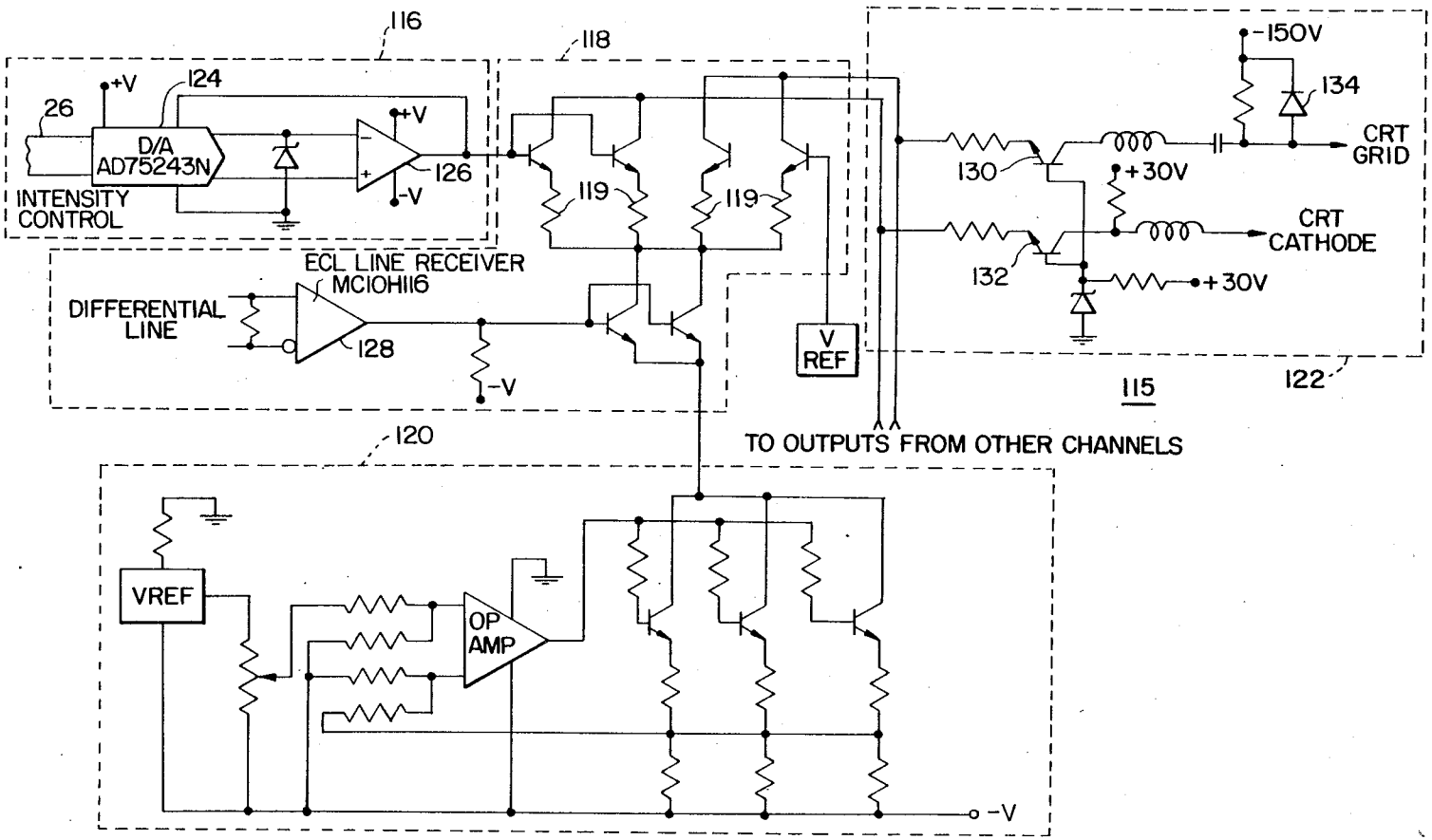
FIG. 10 is a schematic diagram of the digital-to-analog converter circuit 116, the current switch circuit 118, the main current source 120 and the current to voltage converter circuit 122 of FIG. 9.

FIG. 10 is a schematic diagram illustrating the details of one channel 115 (i.e., one of the digital to analog converter circuits 116 and one of the current switching circuits 118) and its connection to the main current source 120 and the current to voltage converter 122. The digital to analog converter circuit 116 includes an 8-bit D/A converter 124 and an operational amplifier 126. The 8-bit D/A converter 124 receives, as the intensity control signal, an 8-bit digital intensity control setting from the central processor 22, via the bus 26. Since the D/A converter 124 is 8-bit, it can be set to 256 different values, so that as the operator varies these 256 settings, the corresponding output channel can assume any one of the 256 values. Similarly, each of the D/A converters 124 in the other digital to analog converter circuits 116 can assume any different set of 256 values. For display purposes, the human eye is capable of distinguishing only approximately 20 different levels, so the capability of providing 256 different levels for each of the channels effectively means that each of the channels is continuously adjustable. The operator is allowed to adjust each of the channels 115 separately (for example, by use of a touch entry display), thereby causing the central processor 22 to send a new 8-bit digital intensity control setting to the channel 115 to be adjusted.

The 8-bit D/A converter 124 outputs a current (in dependence upon the 8-bit digital intensity control setting) to the operational amplifier 126 which provides a voltage signal output to the current switching circuit 118. The current switching circuit 118 comprises high speed ECL switching circuitry, and the voltage across the emitter resistors 119 determines how much current is conducted through each current switching circuit 118. By varying the input to the D/A converter 124, the output voltage of the operational amplifier 126 is varied, and the current capable of flowing through the current switching circuit 118 is varied. The current switching circuit 118 also includes an ECL line receiver 128 which is connected to one of the differential line outputs of the corresponding decoder 106. If the current switching circuit 118 in the channel 115 illustrated in FIG. 10 is selected, then the ECL line receiver 128 generates a switching signal to cause current from the main current source 120 to flow through the current switching circuit 118, so that the current switching circuit 118 generates a current output signal to the current to voltage converter 122. It should be noted that the outputs of the current switching circuit 118 are tied together to provide two inputs to the current to voltage converter 122 because only one of the current switching circuits 118 is selected at a particular time. In summary, the current switching circuit 118 is switched ON and OFF in dependence upon the differential line input from the decoder circuit 106, to allow current from the main current source 120 to flow into the current switching circuit 118; and the voltage output of the digital to analog converter circuit 116 determines the amount of current which is allowed to flow through and be output by the current switching circuit 118. It is necessary to use a current switching circuit 118 instead of a voltage switch because of the high speed operation required for the high resolution raster display generated by the circuit of the present invention. That is, the current switching circuit 118 must be capable of switching at a rate of 210 MHz (i.e., one of the ten channels is selected for each and every pixel 210 million times a second). It would not be possible to have a voltage switch perform this function because of the capacitances in such a system.

The current to voltage converter 122 is a common base amplifier, wherein the current outputs of the current switching circuit 118 are applied to the emitters of transistors 130 and 132. Thus, the switching circuit 118 acts as a variable current source input to the current to voltage converter 122. The drive signal output of the current to voltage converter (essentially a voltage difference) drives the grid in one direction and the cathode in a different direction, so that there is a voltage difference between the two. This voltage difference is translated into a brightness difference.

If color intensity levels are being used as the only attributes for the display, at any one time it is possible to have nine different brightness levels (for each color) on the screen; however, any one of these nine levels can be varied (via the D/A converter 124) to take on 256 different individual levels. In the preferred embodiment, there are nine different variable levels (corresponding to channels 1 through 9) and a tenth channel which is referred to as "black". This is because the grid output of the current to voltage converter 122 is capacity coupled, so that it cannot carry DC components. Therefore, a diode 134 is used to provide a DC restore level to generate the "black" level. Thus, nine of the channels are operator adjustable and the tenth channel provides a maintenance adjustment. In the preferred embodiment, the nine adjustable channels are employed to provide six simultaneous display brightness levels (with the brightness of each level individually and continously adjustable by the operator) and three adjustable shading levels.

In the preferred embodiment, the pixel rate converter 40 and at least a portion of the analog display circuit 28 are built as a hybrid circuit. In particular, it is necessary that the outputs of the pixel rate converter 40 and the inputs of the current switching circuits 118 be essentially in contact with each other because of the high rate at which the data is being processed. Ideally, the pixel rate converter 40 and the amplifier circuits 108, 110 and 112 are built as a hybrid circuit to ensure the ability of the system to provide 210 MHz operation. If the system is instead built from discrete components, then a video bandwidth of from 160 to 180 MHz can be expected. While this will provide a display with substantially higher resolution that is presently available, the use of hybrid circuitry enables the desired high resolution requirements set forth above to be achieved.

Figure 11:
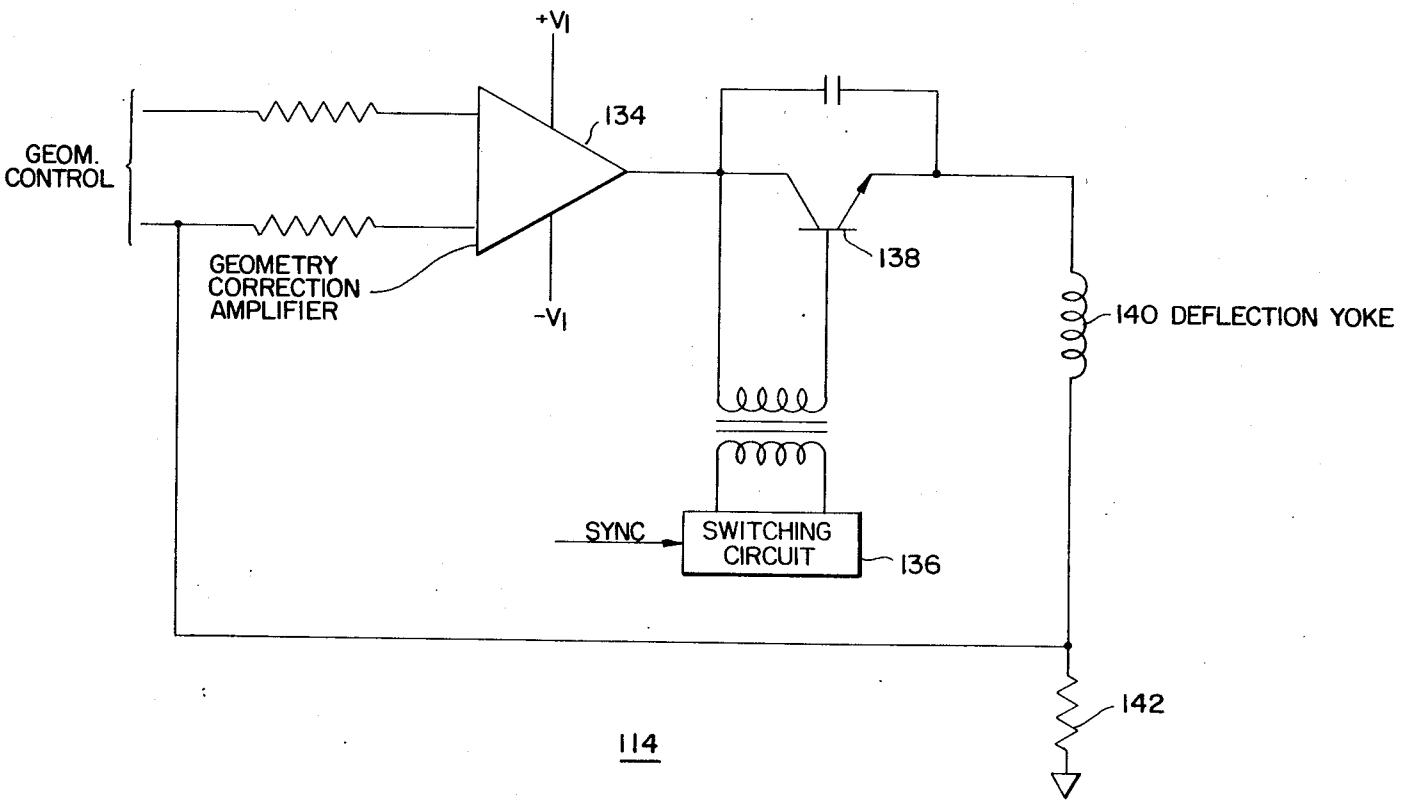
FIG. 11 is a schematic diagram of the display drive circuit 114 of FIG. 8.

FIG. 11 is a block diagram of the display drive circuit 114 of FIG. 8. Prior art stroke writers have used an operational amplifier feedback circuit as a linear deflection amplifier. However, this type of system requires a substantial amount of power to move the current through the deflection yoke quickly. On the other hand, commercial television employs a capacitor and deflection yoke in combination with a switch which is opened and closed to provide a high speed sweep generator. Such a resonant system does not require large amounts of power, but also lacks the control provided by the linear deflection amplifier system used in the stroke writers.

As illustrated in FIG. 11, the display drive circuit 114 used with the present invention is a combination of a linear deflection amplifier and a resonant amplifier. As illustrated in FIG. 11, the display drive circuit 114 includes a geometry correction amplifier 134 and a switching circuit 136 coupled to a transistor 138 which is connected at the output of the geometry correction amplifier 134. Whenever the switching circuit 136 is closed and scanning is actually taking place, the display drive circuit 114 functions as a linear feedback amplifier with a current being provided through a deflection yoke 140, and the voltage across a resistor 142 being fed back to an input of the geometrical correction amplifier 134. When rapid flyback is required, the input sync signal causes the switching circuit 136 to switch and the display drive circuit 114 becomes a resonant amplifier. Thus, in one circuit, the power conserving advantages of a fast flyback resonant amplifier and the control advantages of a linear amplifier, are obtained. The central processor 22 provides geometry control signals to the inputs of the geometry correction amplifier 134 in order to compensate for the different distances which the electron beam must travel in the CRT 30 before striking the screen. For example, an electron beam focused on a corner of the screen travels a much greater distance than a beam striking the center of the screen. The geometry control signals provided by the central processor 22 compensate for this, so that the display provided on the CRT 30 is not distorted.

The operation of the digital image processing circuit 24 of the present invention is as follows. The graphics processor 32 (FIGS. 2, 3) receives image data from the central processor 22 and stores the image data in the display memory 34 (FIGS. 2, 4). The graphics processor 32 also causes data to be read from the display memory 34 and input to the attribute look-up table 38 (FIGS. 2, 6) which receives 8 bits of data for each pixel stored in the display memory 34 and outputs 12 bits of attribute data (4 bits for each of the color guns) as attribute signals. The data stored in the attribute look-up table 38 may be altered by the graphics processor 32, so that the attributes to be displayed for each color may be changed to suit the type of image to be displayed. Further, the alteration of the attribute look-up table 38 can be done without making any changes to the hardware, merely by rewriting the data stored in the attribute look-up table 38. The attribute look-up table 38 provides, as attribute signals, sixteen 12-bit pixels (4 bits per color) as an input to the pixel rate converter 40 (FIGS. 2, 7). In order to meet the requirements of high speed operation, the pixel rate converter 40 converts to high speed ECL logic through the use of the TTL to ECL converter circuits 98 and three multiplexers 102 (1 for each color gun) each receive sixteen 4-bit pixels and output 4 bits at 16 times the rate. The outputs of the multiplexers 102 are then synchronized through sync registers 104 under the control of the 210 MHz clock 94, and sent to decoders 106. Each of the decoders 106 decodes its 4-bit input and generates a display signal on one of ten differential lines which are the outputs of each decoder 106. The display signals are input to the analog display circuit 28 (FIGS. 1 and 8–11) which provides drive signals and a sweep signal to the CRT 30, so that the desired high resolution raster display is formed on the screen.

The digital image processing circuit of the present invention provides significant advantages for high resolution raster display systems because of its high data rate and corresponding wide video bandwidth. Further, the provision of the progammable attribute look-up table provides a simple means for changing the set of attributes which is applicable to a particular type of display to be shown on the CRT 30. While the circuit of the present invention has been described in the context of a common console for an air traffic control station, the digital image processing circuit of the present invention is applicable to any type of raster display system where a high resolution display is required. For example, the digital image processing circuit of the present invention would be particularly suitable for use in computer graphics display systems, CAD/CAM systems, medical diagnostic systems employing a display, and military monitor systems. Further, while the circuit of the present invention has been described in the context of generating a color display, the same circuitry can also be used to generate a monochrome display. In this case, an even greater number of attributes may be made available for display on the screen of the CRT 30.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A circuit for processing digital image data for use in a raster display system having an analog display circuit for driving a CRT having a screen, comprising:

data generating means for providing digital image data defining a plurality of pixels to be displayed on a screen of a CRT, for providing a read signal, and for providing attribute data for defining a category of each pixel to be displayed on the screen of the CRT, the pixels being capable of being categorized in a plurality of categories;

image storage means coupled to said data generating means, for storing the digital image data and for reading out the digital image data for each pixel, as pixel data, under the control of the read signal;

attribute storage means, coupled to said data generating means and said image storage means, for storing the attribute data and for providing an attribute signal, as an output in response to receiving from said image storage means the pixel data corresponding to each pixel, the attribute data stored in said attribute storage means being addressed by the pixel data read from said image storage means; and conversion means, coupled to said attribute storage means and to the analog display circuit, for receiving the attribute signals for the pixels in the form of parallel input data at a first rate, and for generating a display signal for each pixel at a second rate which is greater than the first rate, said conversion means having a plurality of differential line outputs corresponding to the number of categories of pixels, the display signal for each pixel being output on only a selected one of the differential line outputs in dependence upon the attribute signal read from said attribute storage means.

2. A circuit for processing digital image data for use in a raster display system having an analog display circuit for driving a CRT having a screen, comprising:

data generating means for providing digital image data defining a plurality of pixels to be displayed on a screen of a CRT, for providing a read signal, and for providing attribute data for defining the category of each pixel to be displayed on the screen of the CRT, the pixels being capable of being categorized in a plurality of categories;

image storage means, coupled to said data generating means, for storing the digital image data and for reading out the digital image data for each pixel, as pixel data, under the control of the read signal;

attribute storage means, coupled to said data generating means and said image storage means, for storing the attribute data and for providing an attribute signal, as an output in response to receiving from said image storage means the pixel data corresponding to each pixel, the attribute data stored in said attribute storage means being addressed by the pixel data read from said storage means;

conversion means, coupled to said attribute storage means and to the analog display circuit, for receiving the attribute signals for the pixels in the form of parallel input data at a first rate, and for generating a display signal for each pixel at a second rate which is greater than the first rate, said conversion means having a plurality of differential line outputs corresponding to the number of categories of pixels, the display signal for each pixel being output on only a selected one of the differential line outputs in dependence upon the attribute signal read from said attribute storage means;

means for converting the attribute signals for the plurality of pixels to ECL logic;

means for providing a clock signal operating at the second rate;

means, coupled to said converting means and said means for providing the clock signal, for multiplexing the ECL converted attribute signals for the plurality of pixels under the control of said clock into a serial multiplexed signal; and means, coupled to said multiplexer means and the analog display circuit, for decoding the serial multiplexed signal and for providing the display signal on the selected one of the differential line outputs to the analog display circuit at the second rate.

3. A circuit as set forth in claim 2, wherein said data generating means comprises:

a first graphics data controller for generating the read signal to refresh the screen of the CRT;

a second graphics data controller for generating the digital image data defining pixels to be displayed on the screen of the CRT; and means for providing the attribute data.

4. A circuit as set forth in claim 3, wherein said image storage means comprises a dynamic random access memory.

5. A circuit as set forth in claim 4, wherein said attribute storage means comprises a random access memory.

6. A circuit for processing digital image data for use in a raster display system having an analog display circuit for driving first, second and third color guns of a CRT having a screen, comprising:

data generating means for providing digital image data defining a plurality of pixels to be displayed on a screen of a CRT;

attribute generating means for providing attribute data for defining the attributes of the images to be displayed on the CRT, the attribute data defining different categories of pixels which can be displayed on the screen of the CRT;

read signal means for providing a read signal;

a display memory, coupled to said data generating means and said read signal means, for storing the digital image data and for reading out the digital image data for each pixel, as pixel data, under the control of the read signal;

an attribute, lock-up table, coupled to said display memory and said attribute generating means, for storing the attribute data and for providing, first, second and third attribute signals corresponding to the first, second and third color guns of the CRT, as an output in response to receiving the pixel data corresponding to each pixel, the attribute data stored in said attribute look-up table being addressed by the pixel data for each pixel read from said display memory; and a pixel rate converter, coupled to said attribute look-up table and to the analog display circuit, for receiving the first, second and third attribute signals for a plurality of pixels at a first rate, said pixel rate converter comprising:

conversion means for converting the first, second and third attribute signals for each of the plurality of pixels to ECL logic, a clock operating at a second rate for generating first, second and third display signals for each pixel at the second rate which is greater than the first rate;

means coupled to said converting means and said clock for multiplexing the ECL converted first, second and third attribute signals for the plurality of pixels under the control of said clock into first, second and third serial multiplexed signals for each pixel; and decoding means, coupled to said multiplexer means and the analog display circuit, for decoding the first, second and third serial multiplexed signals and for providing the first, second and third display signals for each pixel to the analog display circuit at the second rate, the analog display circuit driving the first, second and third color guns of the CRT for each pixel in dependence upon the first, second and third display signals, respectively.

7. A circuit as set forth in claim 6, wherein said display memory comprises a dynamic random access memory.

8. A circuit as set forth in claim 7, wherein said attribute look-up table comprises a random access memory.

9. A circuit for processing digital image data for use in a raster display system having an analog display circuit for driving a CRT having a screen, comprising:

image data generating means for providing digital image data defining a plurality of pixels to be displayed on a screen of a CRT;

attribute data generating means for providinpg attribute data for defining a category of each pixel to be displayed on the screen of the CRT, the pixels being capable of being categorized in a plurality of different categories;

read signal means for providing a read signal;

a display memory, coupled to said image data generating means and said read signal means, for storing the digital image data and for reading out the digital image data for each pixel, as pixel data, under the control of the read signal;

an attribute look-up table, coupled to said display memory and said attribute data generating means, for storing the attribute data and for providing an attribute signal, as an output in response to receiving from said display memory the pixel data corresponding to each pixel, the attribute data stored in said attribute look-up table being addressed by the pixel data read from said display memory;

a pixel rate converter, coupled to said attribute look-up table and to the analog display circuit, for receiving the attribute signals for the pixels in the form of parallel input data at a first rate, and for generating a display signal for each pixel at a second rate greater than the first rate, said pixel rate converter having a plurality of differential line outputs corresponding to the number of categories of pixels, the display signal for each pixel being output on only one of the differential line outputs in dependence upon the attribute signal read from said attribute look-up table means for converting the attribute signals for the plurality of pixels to ECL logic;

a clock operating at the second rate;

means, coupled to said converting means and said clock, for multiplexing the ECL converted attribute signals for the plurality of pixels under the control of said clock into a serial multiplexed signal; and means, coupled to said multiplexer means and the analog display circuit, for decoding the serial multiplexed signal and for providing the display signal for each pixel on the selected one of the differential line outputs to the analog display circuit at the second rate.

10. A circuit as set forth in claim 9, wherein said display memory comprises a dynamic random access memory.

11. A circuit as set forth in claim 10, wherein said attribute look-up table comprises a random access memory.

* * * * *